US008695137B1

(12) United States Patent
Hanson

(10) Patent No.: US 8,695,137 B1
(45) Date of Patent: Apr. 15, 2014

(54) PORTABLE DIAPER-CHANGING RESTRAINT SYSTEM

(71) Applicant: Lisa Cash Hanson, Las Vegas, NV (US)

(72) Inventor: Lisa Cash Hanson, Las Vegas, NV (US)

( * ) Notice: Subject to any disclaimer, the term of this patent is extended or adjusted under 35 U.S.C. 154(b) by 0 days.

(21) Appl. No.: 13/652,397

(22) Filed: Oct. 15, 2012

(51) Int. Cl.
*A47D 13/08* (2006.01)
*A61B 19/00* (2006.01)

(52) U.S. Cl.
USPC ..... 5/655; 128/869

(58) Field of Classification Search
USPC ..... 5/513, 603, 636, 637, 654, 655, 655.3, 5/945
See application file for complete search history.

(56) References Cited

U.S. PATENT DOCUMENTS

| | | | | | |
|---|---|---|---|---|---|
| 98,859 | A | | 1/1870 | Fast | |
| 1,212,515 | A | | 1/1917 | Leavitt | |
| D124,296 | S | | 12/1940 | Thompson | |
| 2,561,931 | A | | 7/1951 | Kleiser | |
| 3,493,228 | A | | 2/1970 | Hicks | |
| 4,117,781 | A | | 10/1978 | Middleton | |
| 4,178,926 | A | | 12/1979 | Cohn | |
| 4,197,604 | A | | 4/1980 | Nakamura | |
| 4,205,669 | A | * | 6/1980 | Hamann | 5/603 |
| 4,731,890 | A | * | 3/1988 | Roberts | 5/655 |
| 5,133,098 | A | * | 7/1992 | Weber | 5/655 |
| 5,161,270 | A | | 11/1992 | Najmabadi | |
| 5,261,134 | A | | 11/1993 | Matthews | |
| 5,309,926 | A | | 5/1994 | Mayton | |
| 5,313,678 | A | | 5/1994 | Redewill | |
| 5,519,906 | A | * | 5/1996 | Fanto-Chan | 5/631 |
| 5,546,620 | A | * | 8/1996 | Matthews | 5/655 |
| 5,581,833 | A | | 12/1996 | Zenoff | |
| D146,745 | S | | 11/1999 | Noyes | |
| 6,009,874 | A | | 1/2000 | Sartin | |
| 6,061,854 | A | * | 5/2000 | Crowley | 5/655 |
| 6,224,450 | B1 | | 5/2001 | Norton | |
| 6,810,545 | B1 | * | 11/2004 | Darling et al. | 5/655 |
| 6,854,142 | B2 | | 2/2005 | Lukomshiy | |
| 7,178,877 | B2 | * | 2/2007 | Watson | 297/484 |
| 7,624,461 | B2 | | 12/2009 | Tidwell | |
| 7,657,955 | B1 | * | 2/2010 | Alvistur et al. | 5/655 |
| 2002/0042953 | A1 | | 4/2002 | Brown | |
| 2004/0060116 | A1 | * | 4/2004 | Matthews Brown | 5/636 |
| 2006/0272651 | A1 | * | 12/2006 | Ortel | 128/869 |

OTHER PUBLICATIONS

Changing Buddy; www.diaperchangingpillow.com/Default.aspx, last accessed Oct. 6, 2012.
Woogie 2; http://store.griffintechnology.com/woogie-2, last accessed Mar. 12, 2013.

* cited by examiner

*Primary Examiner* — William Kelleher
*Assistant Examiner* — David R Hare
(74) *Attorney, Agent, or Firm* — Connie R. Masters

(57) ABSTRACT

A portable diaper-changing restraint system is provided that includes a resilient, substantially U-shaped body having two cantilever arms and a removable cover assembly configured to fully enclose the U-shaped body. The cover assembly includes a strap having a first end attached or attachable to one arm and having a second end configured with an attached fastening device for attaching to the opposing arm. In use, the infant is positioned on the strap with the U-shaped body brought over and onto the infant's waist; then the strap is attached. Thus the U-shaped body is positioned around the infant's torso with the ends of the cantilever arms resting on the surface upon which the baby is lying, reducing the ability of the infant to turn and holding the infant's hands away from the diaper area.

15 Claims, 4 Drawing Sheets

Fig. 4
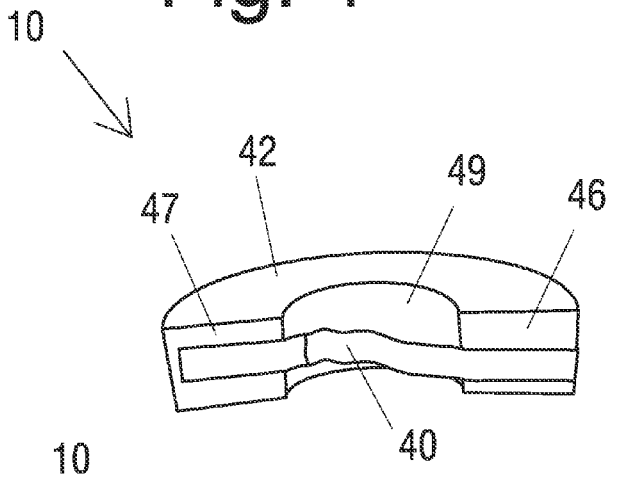
Fig. 5
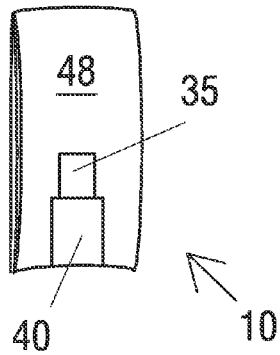
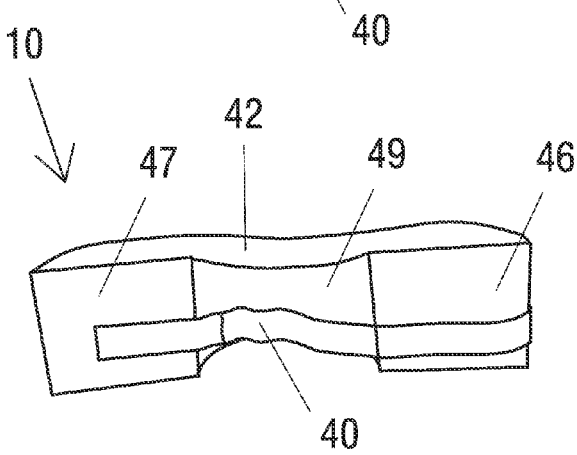
Fig. 6
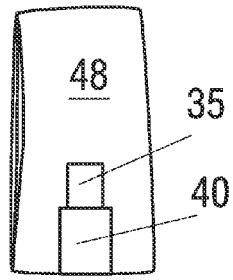
Fig. 7

PORTABLE DIAPER-CHANGING RESTRAINT SYSTEM

FIELD OF INVENTION

This invention relates generally to baby products, and, more particularly, to a portable diaper-changing restraint system with a resilient inner body for fitting around an infant's torso.

BACKGROUND OF THE INVENTION

Changing an infant's diaper is often challenging to parents or other caregivers. Holding the baby's legs with one hand while the other hand simultaneously cleans the baby and reaches for all of the items needed is taxing, but it is particularly difficult when changing a dirty diaper. Caregivers need the baby to remain still to efficiently and sanitarily change the diaper. Yet, babies enjoy freedom and movement. Thus, they are likely to resist being held still during the process. The uncooperative baby may attempt to roll over, to sit up, or to place his hands in the diaper area, risking contamination of additional surfaces.

To address this problem, a variety of diaper-changing aids have been developed. Many of the diaper-changing devices include a flat table, board or surface upon which the baby lies with a belt or harness of some type for restraining the baby to the flat board. Though these devices can be made sturdy enough to restrain a wiggling baby, the baby often resents the restriction and becomes distressed and agitated, fighting against the confinement and expressing his discomfort loudly. This does not lead to a happy diaper-changing experience for the baby or the caregiver.

Accordingly, there is a need for a diaper-changing system that comfortably limits the baby's movement and also shields the baby's hands from accessing the diaper area, while providing a distraction or diversion to occupy the baby's attention for the time required to change a diaper.

BRIEF SUMMARY OF THE INVENTION

The present invention is directed to a portable diaper-changing restraint system that includes a resilient, substantially U-shaped body encased in a washable, removable cover. The body has a medial region and first and second cantilever arms extending from opposite ends of the medial region to define a central U-shaped opening sized to accommodate the infant's waist. Each of the cantilever arms terminate in a blunt end. The cover assembly includes a preferably adjustable strap having a first end attached or attachable to a first cantilever arm of the U-shaped body and having a second end configured with an affixed fastening device for attaching to a corresponding fastening device affixed to the second cantilever arm.

The cover-encased body of the diapering restraint is placed around the waist of the baby with the blunt ends positioned on the surface upon which the baby is lying. A strap extends under the baby from the first cantilever arm to the second cantilever arm to secure the baby within the central U-shaped opening. The diaper-changing restraint system retains the baby's hands on the front side of the diapering restraint, holding them away from the diaper area, while reducing the ability of the baby to turn.

Other aspects of the portable diaper-changing restraint system provide optional variations. These include a pocket allowing viewing of an item (such as a mobile phone) placed within the pocket; an attention-grabbing attachable or attached diversion device (such as toy, image, or learning aid); one or multiple connectors attached on an upper area of the front surface of the cover assembly configured to receive attachable diversion devices; and variations in bags for containing the diaper-changing restraint, including a bag incorporating a diaper-changing pad.

In use, the portable diaper-changing restraint system comfortably limits the baby's movement and shields the baby's hands from accessing the diaper area, while providing a distraction or diversion to occupy the baby's attention for the time required for changing a diaper.

An object of the present invention is to provide a diaper-changing restraint system that is comfortable for the baby.

An additional object is to provide a diaper-changing restraint system that retains the baby's hands on the forward side of the diaper-changing restraint system, preventing the hands from reaching the diaper area.

A further object is to provide a diaper-changing restraint system that limits the baby's movements.

These and other objects, features, and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements, and in which:

FIG. 4 depicts a bottom perspective view of the ends of the cantilever arms of the first embodiment with the U-shaped body encased in the cover assembly;

FIG. 5 depicts a side view of the portable diaper-changing restraint system of the first embodiment with the U-shaped body encased in the cover assembly;

FIG. 6 depicts a bottom perspective view of the ends of the cantilever arms of the second embodiment with the U-shaped body encased in the cover assembly;

FIG. 7 depicts a side view of the portable diaper-changing restraint system of the second embodiment with the U-shaped body encased in the cover assembly;

Like reference numerals refer to like parts throughout the several views of the drawings.

DETAILED DESCRIPTION OF THE INVENTION

Shown throughout the figures, the present invention is directed toward a lightweight, portable diaper-changing restraint system. The diaper-changing restraint system is comfortable for the baby, yet restricts the baby's hands to the front side of the restraint while gently holding the baby in place. The flat ends resting on the diaper-changing surface limit the movement of the baby, thus allowing the caregiver to clean the diaper area and change the diaper more easily. Optional means to attach and to display various diversion devices to aid in entertaining and distracting the baby are also disclosed. Additionally, optional variations in carrying bags for receiving and transporting the restraint device are presented.

Figure 1:
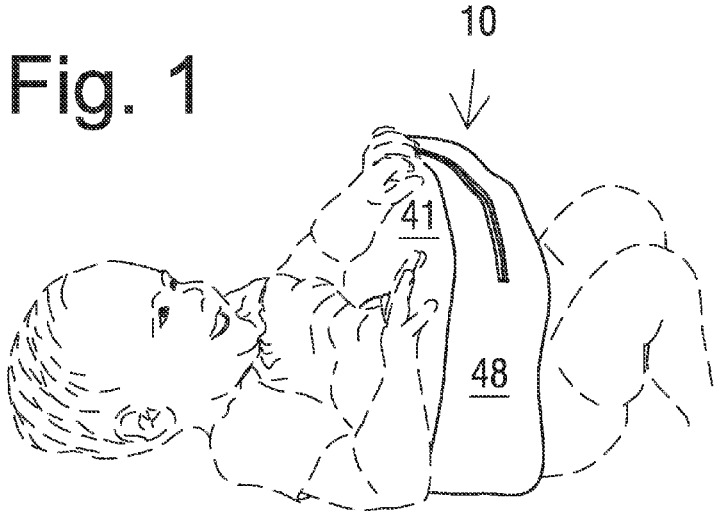
FIG. 1 depicts a right side perspective view of the portable diaper-changing restraint system of the first embodiment in the environment of use.
Figure 2:
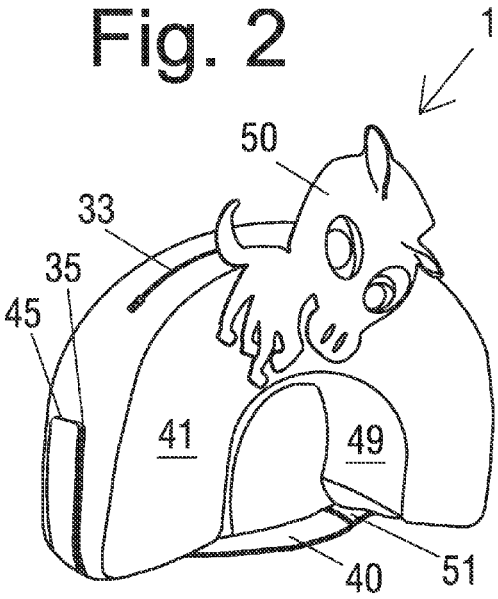
FIG. 2 depicts a front perspective view of the portable diaper-changing restraint system of the first embodiment with the U-shaped body encased in the cover assembly.
Figure 3:
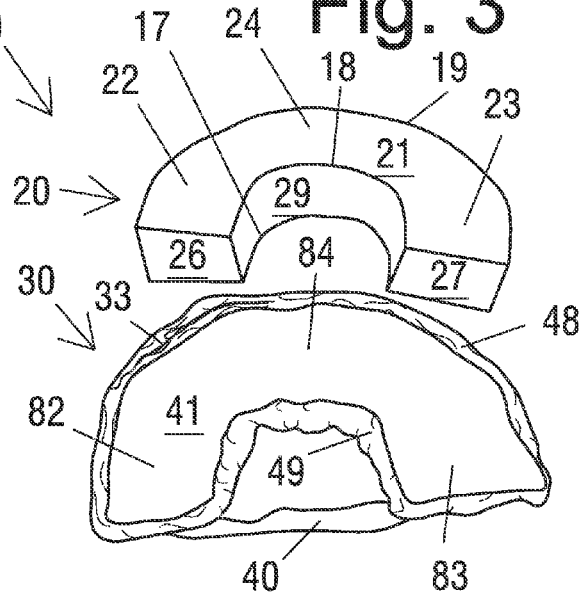
FIG. 3 depicts a front perspective view of the portable diaper-changing restraint system of the first embodiment with the resilient U-shaped body removed from the cover assembly.

Referring to FIGS. 1, 2, 3, 4, and 5, the portable diaper-changing restraint system is illustrated in accordance with the first embodiment of the present invention. The diaper-changing restraint system of the first embodiment includes the diapering restraint 10 comprising an inner substantially U-shaped body 20 (FIG. 3) and a removable cover assembly 30 (FIG. 3). A strap 40 (FIG. 2) secures the baby within the restraint device 10.

As shown in FIG. 1, when in use, the diapering restraint 10 is configured to be positioned around the baby's waist or torso. FIG. 2 illustrates the U-shaped body 20 encased in the cover assembly 30, while FIG. 3 illustrates the diapering restraint 10 with the U-shaped body 20 removed from the cover assembly 30.

The substantially U-shaped body 20 is soft and resilient for the comfort of the baby. The body 20 may be made of a conventional pillow material, for example an open-cell or closed-cell manufactured foam (such as polyurethane foam, polystyrene foam or the like); or the body 20 may be a formed inflatable pillow. U-shaped body 20 includes a medial region 24 disposed between a first cantilever arm 22 and a second cantilever arm 23. The arms 22, 23 extend from opposite ends of the medial region 24 to define a central U-shaped opening sized to accommodate the infant's waist. Both arms 22, 23 end in blunt ends 26, 27. The blunt ends 26, 27 form a substantially horizontal plane, which, when the restraint 10 is in use, is positioned facing downward with the ends 26, 27 lying flat on the surface on which the baby is lying. The securing strap 40 holds the diapering restraint 10 onto the baby while the flat ends 26, 27 abut the flat surface, thus gently encouraging the baby to remain still, as it is more difficult for the baby to turn or roll. This is in direct contrast to most conventional diapering restraints which have a flat board upon which the baby lies to prevent the baby's movement and have a securing strap over the baby, instead of under the baby.

The U-shaped body 20 includes a front surface 21 (FIG. 3); a back surface (under cover back surface 42, as seen in FIG. 4); an outer side/top wall (under cover outer side/top wall 48, as seen in FIG. 1) having a back edge and a front edge 18; and an inner bottom wall 29 having a back edge 17 and a front edge 18. The front surface 21 extends from the front edge 19 of the outer side/top wall to the front edge 18 of the inner bottom wall 29. In the first embodiment, the outer side/top wall has an approximately constant horizontal thickness which is equal to the approximately constant horizontal thickness of the inner bottom wall 29, thus the body 20 is substantially flat and equal in thickness throughout.

The removable cover assembly 30 (FIG. 3) is configured to fully enclose the U-shaped body 20. The cover assembly 30 has a front surface 41, a back surface 42 (FIG. 4), a first cantilever arm end 46, a second cantilever arm end 47, an inner bottom wall 49, and an outer side/top wall 48 (FIG. 1), which are configured to cover the front surface 21, back surface, first cantilever arm end 26, second cantilever arm end 27, inner bottom wall 29, and outer side/top wall, respectively, of U-shaped body 20. The cover assembly also includes a strap 40, which can be used to secure the restraining device 10 around the baby, when desired. The strap 40 may have one end attached to one of the arms and the opposing end configured with a fastening device 45 that is attachable to the opposing arm, or the strap 40 may have a fastening device 45 on both ends and be attachable to, and removable from, both arms 46, 47. The first embodiment shows the strap 40 fixedly attached to the second arm 47 and removably attachable, via fastening device 45, to a corresponding fastening device 35 (FIGS. 2, 5). Fastening device 45 may be any quick attaching and quick releasing fastener, such as one or more snaps, a section of hook-and-loop-type fastener, or the like. Optionally, strap 40 may also incorporate an elastic portion 51 (FIG. 2) to allow the strap 40 to stretch for comfort of the baby.

The removable cover assembly 30 is preferably formed of a washable natural or manufactured fabric, such as cotton, bamboo, rayon, polyester, or similar fibers or blends. Optionally, the cover assembly 30 may be quilted or fleeced for additional softness.

A diversion device 50 may be attached or attachable to the front surface 41 of cover 30. The diversion device 50 may be a toy, a learning aid, an image, or similar engaging apparatus suitable for the age of the baby. In one example, an embroidered animal may be sewn to the front surface 41 as a diversion device 50.

In the first embodiment of FIGS. 1-5, the plane formed by the front surface and the plane formed by back surface of body 20 are substantially parallel. This can be seen in FIG. 4, which illustrates the bottom ends 47, 48 of the cantilever arms of cover assembly encasing the ends 26, 27 of the U-shaped body 20, and in FIG. 5, which illustrates a side view of the U-shaped body 20 encased in the cover assembly 30.

In contrast, in the second embodiment of FIGS. 6-7, the bottom ends 47, 48 of the cantilever arms of cover assembly 30 encasing the ends 26, 27 of the U-shaped body 20 are larger, while the medial region 24 remains the same thickness as in the first embodiment. Thus the ends 26, 27 present a larger flat surface that, when positioned against the diapering surface, increase the stability of the restraint device 10, thereby further encouraging the baby to remain in position without turning. In the second embodiment, no plane is formed by the front surface of body 20, with the medial region 24 forming a slight hollow to provide space for the baby's hands, while the ends 26, 27 are wider.

Figure 8:
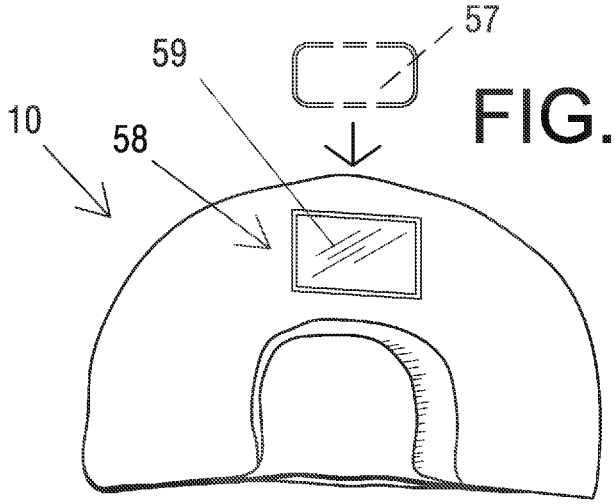
FIG. 8 depicts a front perspective view of the portable diaper-changing restraint system of the third embodiment including a pocket with a viewing window.

FIG. 8 illustrates the third embodiment of the diaper-changing restraint system of the present invention, which is further configured to incorporate an attached pocket 58 with a substantially transparent viewing window 59. In the third embodiment, the caregiver can place a diversion device within the pocket 58 to entertain or amuse the baby during the diaper change. Pocket 58 is preferably sized and shaped to accommodate a mobile phone 57, though other diversion devices, such as pictures and objects could be placed within the pocket 58. For example, pocket 58 may be sewn onto the front surface 41 of diapering restraint 10.

Figure 9:
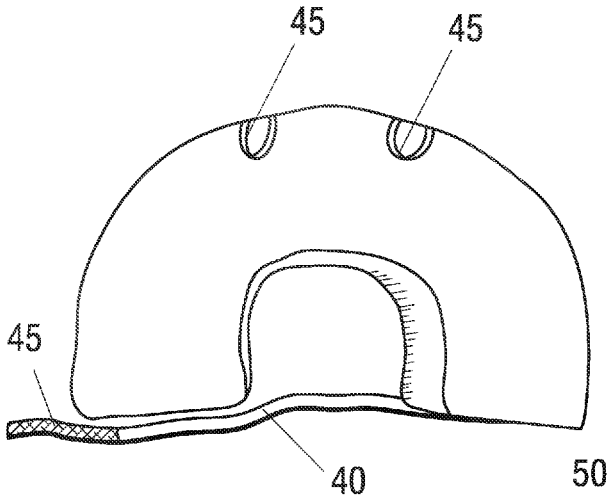
FIG. 9 depicts a front perspective view of the portable diaper-changing restraint system of the fourth embodiment including connections for removably connecting a removable pocket or a distraction device.
Figure 10:
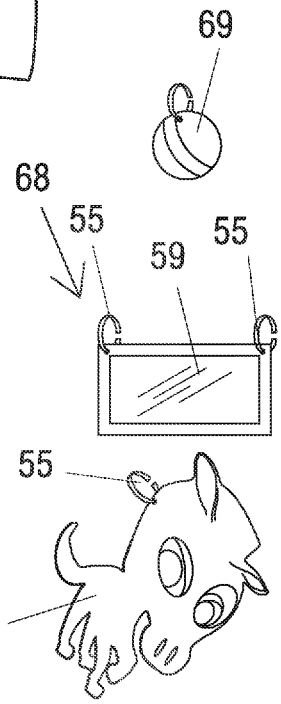
FIG. 10 depicts a front view attachable accessories of the portable diaper-changing restraint system of the fourth embodiment.

FIG. 9 illustrates the fourth embodiment of the diaper-changing restraint system, which includes one or more connections 45 for removably attaching a connectable accessory, such as a distraction device 50, 69 or a removable pocket 68 (configured for receiving a mobile phone 57). Suitable exemplary connectable accessories are shown in FIG. 10; they are configured with a corresponding connection device 55. Connection devices 45 are shown in FIG. 9 as loops and corresponding connection device 55 is shown as a C-shaped link which may be attached to the loop. However, other connection devices 45 and corresponding connection devices 55, as are known or become known in the art are also usable. For example, connection devices 45 may be a hard plastic hook, a section of hook and loop material, or the like.

Figure 11:
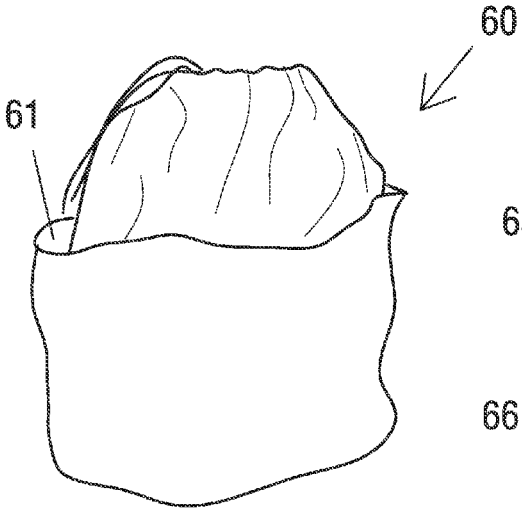
FIG. 11 depicts a front perspective view of a receiving bag of the fifth embodiment for receiving and transporting the diapering restraint; therefore, the fifth embodiment of the present invention comprises both a diapering restraint and a bag.

In the fifth embodiment, the portable diaper-changing restraint system comprises both diapering restraint 10 and a restraint-receiving bag 60. As shown in FIG. 11, bag 60 is sized and configured for receiving and transporting the diapering restraint 10 of the present invention. A top opening allows manual insertion of the restraint 10. The bag 60 may have exterior pockets 61 such as for conveniently carrying additional diapering supplies. The bag 60 of the fifth embodiment may be formed of natural or manufactured fabrics with optional reinforcements, such as a bottom insert to hold the bag in shape.

Figure 13:
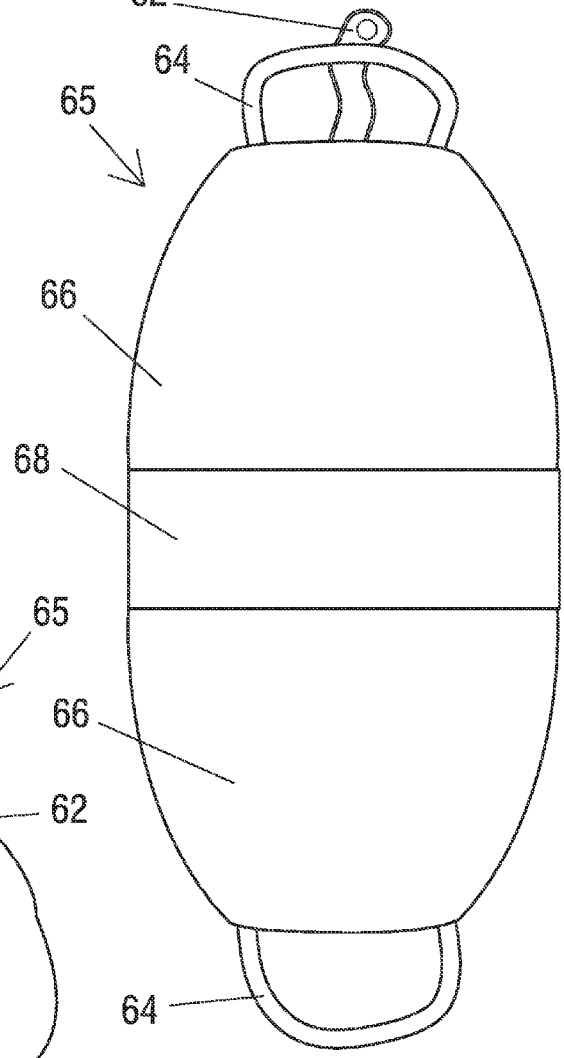
FIG. 13 depicts a top view of the bag of FIG. 11 with the diapering restraint removed from the bag and the bag spread flat on a diapering surface to form a diaper-changing mat.
Figure 12:
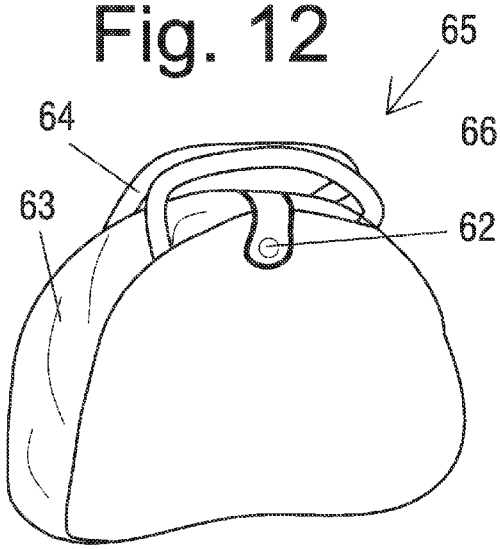
FIG. 12 depicts a front perspective view of a receiving bag incorporating a diaper-changing mat of the sixth embodiment, which is in use for receiving and transporting the diapering restraint; therefore, the sixth embodiment of the present invention comprises both a diapering restraint and a bag.

In the sixth embodiment, the portable diaper-changing restraint system also comprises both diapering restraint 10 and a restraint-receiving bag 60. FIGS. 12-13 illustrate a second variation of bag 65 for receiving and transporting the restraint device 10 of the present invention. The second bag 65 is configured with opposing sides 66 and a center section 68. Handles 64 are preferably included for ease of carrying. The sides 66 generally conform to, but are slightly larger than, the U-shape of the body 20; therefore, sides 66 have a generally half-oval shape. The center section 68 is configured and sized to receive the ends 26, 27 of the body 20. Therefore, center section 68 has a width slightly greater than the width of the ends 26, 27 and a length slightly greater than the length between the outside edges of the ends 26, 27. FIG. 12 shows the bag enclosing the restraint device 10, while FIG. 13 shows the bag 65 opened with the restraint device 10 removed. As shown in FIG. 13, the bag 65 opens flat forming a diaper-changing mat, thereby providing a sanitary location upon which to lay the baby. The bag 65 may be formed of a padded or fleeced material to increase the comfort of the baby.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A diaper-changing restraint system for placing on a diaper-changing surface, comprising:

a substantially U-shaped body formed of a resilient material including a medial region, first and second cantilever arms of equal length extending from opposite ends of said medial region, and a body inner bottom wall defining a central U-shaped interior region opening sized to accommodate an infant's waist; wherein said first and second body cantilever arms end in a first and second body blunt end, respectively, each forming a flat, horizontal plane for placing downward on said diaper-changing surface with said medial region then positioned upwardly; wherein said body inner bottom wall extends from said first body blunt end to said second body blunt end and has a back edge and a front edge; wherein said U-shaped body further includes a body front surface, a body back surface, a body outer side/top wall that extends from said first body blunt end to said second body blunt end along the exterior of said U-shaped body and has a back edge and a front edge; wherein said body front surface extends from said front edge of said body outer side/top wall to said front edge of said body inner bottom wall, wherein said body outer side/top wall has an approximately constant thickness which is equal to or greater than an approximately constant thickness of said body inner bottom wall;

a removable cover assembly configured to fully enclose said U-shaped body, wherein said removable cover assembly has a cover front surface, a cover back surface, a first cover cantilever arm comprising a cover blunt end having a first cover blunt end inner and outer edge, a second cover cantilever arm comprising a second cover blunt end having a second cover blunt end inner and outer edge, a cover inner bottom wall extending from said first cover blunt end inner edge to said second cover blunt end inner edge; and a cover outer side/top wall positionable to cover said body front surface, said body back surface, said first body cantilever arm end, said second body cantilever arm end, said body inner bottom wall, and said body outer side/top wall, respectively; and wherein said removable cover assembly comprises a strap having a distal and proximal end with said proximal end attached to said first cantilever arm; wherein said strap is sufficiently long to reach from said first cantilever arm past said second cover blunt end inner edge; wherein said distal end of said strap is configured with a first fastening device; wherein said second cover blunt end is configured with a corresponding second fastening device positioned outside of said central U-shaped interior region and configured for removably attaching to said first fastening device for securing the infant's torso within said central U-shaped interior region; and said removable cover assembly further comprises a pocket fixedly attached to said cover front surface of said removable cover assembly; said medial region comprises a medial region top surface at the apex of said U-shaped body when said first and second body blunt ends are placed downward on said diaper-changing surface; said pocket comprises a top opening oriented upward toward said medial region top surface, whereby an object can be inserted into said pocket; said pocket comprises a front opening, whereby at least a portion of said object can be viewed within said pocket; and said pocket is sized to contain a mobile phone.

2. The diaper-changing restraint system of claim 1, wherein said U-shaped body comprises a resilient formed cushion.

3. The diaper-changing restraint system of claim 1, wherein said U-shaped body comprises an inflatable form.

4. The diaper-changing restraint system of claim 1, wherein said U-shaped body is formed of a single piece of resilient solid foam-type material having substantially the same firmness throughout.

5. The diaper-changing restraint of claim 1, wherein:

said first fastening device of said strap comprises a section of hook and loop fastener; and said corresponding second fastening device of said removable cover assembly comprises a corresponding section of hook and loop fastener.

6. The diaper-changing restraint system of claim 1, wherein said removable cover assembly includes at least one connector attached on an upper area of said front surface of said removable cover assembly.

7. The diaper-changing restraint system of claim 6, wherein said removable cover assembly includes two connectors attached to an upper area of said cover front surface of said removable cover assembly; and wherein said diaper-changing restraint system further comprises a pocket attachable to said connectors of said removable cover assembly.

8. The diaper-changing restraint system of claim 1, wherein said front opening of said pocket comprises a transparent insert allowing viewing of at least part of said object placed within said pocket.

9. The diaper-changing restraint of claim 1, wherein said thickness of said body outer side/top wall is approximately equal to said thickness of said body inner bottom wall at said medial region and at said first and second body blunt ends.

10. The diaper-changing restraint system of claim 1, wherein said thickness of said body outer side/top wall is approximately equal to said thickness of said body inner bottom wall at said medial region and wherein said thickness of said body outer side/top wall is greater than said thickness of said body inner bottom wall at said first and second body blunt ends of said first and second cantilevered arms.

11. The diaper-changing restraint system of claim 1, further comprising a bag sized and configured to accommodate said U-shaped form.

12. The diaper-changing restraint of claim 11, wherein:

said bag comprises a diaper-changing pad;

said bag can be fully opened flat; and said bag comprises a padded or fleece material, whereby the comfort of the baby is increased when positioned on said bag that has been opened flat.

13. The diaper-changing restraint of claim 1, wherein at least a portion of said strap is formed of a stretchable material.

14. The diaper-changing restraint system of claim 1, wherein said proximal end of said strap is removably attachable to said first cover blunt end of said removable cover assembly.

15. A diaper-changing restraint system for placing on a diaper-changing surface, consisting of:

a substantially U-shaped body formed of a single piece of a resilient material including a medial region, first and second cantilever arms of equal length extending from opposite ends of said medial region, and a body inner bottom wall defining a central U-shaped interior region opening sized to accommodate the infant's waist; wherein said first and second body cantilever arms end in a first and second body blunt end, respectively, each forming a flat, horizontal plane for placing downward on said diaper-changing surface; wherein said body inner bottom wall extends from said first body blunt end to said second body blunt end and has a back edge and a front edge; wherein said U-shaped body further includes a body front surface, a body back surface, a body outer side/top wall that extends from said first body blunt end to said second body blunt end along the exterior of said U-shaped body and has a back edge and a front edge; wherein said body front surface extends from said front edge of said body outer side/top wall to said front edge of said body inner bottom wall, wherein said body outer side/top wall has an approximately constant thickness which is equal to or greater than an approximately constant thickness of said body inner bottom wall; and a removable cover assembly configured to fully enclose said U-shaped body, wherein said removable cover assembly has a cover front surface, a cover back surface, a first cover blunt end, a second cover blunt end, a cover inner bottom wall, and a cover outer side/top wall positionable to cover said front body surface, said back body surface, said first body blunt end, said second body blunt end, said inner body bottom wall, and said body outer side/top wall; wherein said removable cover assembly comprises a pocket attached to said cover front surface; wherein said pocket has a front opening allowing viewing of at least part of an article within said pocket; wherein said pocket is sized to contain a mobile phone; wherein said removable cover assembly further comprises an adjustable strap having a distal and proximal end with said proximal end attached to said first cover blunt end; wherein said distal end of said strap is configured with a first hook-and-loop fastening device; wherein said removable cover assembly further comprises a corresponding hook-and-loop fastening device attached to said second cover blunt end; and said first hook-and-loop fastening device is removably attachable to said corresponding hook-and-loop fastening device.

* * * * *